US006105693A

United States Patent [19]

Ingmarsson

[11] Patent Number: 6,105,693

[45] Date of Patent: Aug. 22, 2000

[54] PARTIALLY ENHANCED PERCUSSIVE DRILL BIT

[75] Inventor: Karl Ingmarsson, Houston, Tex.

[73] Assignee: Sandvik AB, Sandviken, Sweden

[21] Appl. No.: 09/252,476

[22] Filed: Feb. 18, 1999

[51] Int. Cl.[7] ..... E21B 10/36; E21C 25/10

[52] U.S. Cl. ..... 175/414; 175/420.2; 175/418; 299/100

[58] Field of Search ..... 175/414, 420.1, 175/420.2, 419, 420, 348, 415, 417, 418, 431; 299/100

[56] References Cited

U.S. PATENT DOCUMENTS

| | | | |
|---|---|---|---|
| 3,071,201 | 1/1963 | Phipps | 175/426 |
| 3,388,756 | 6/1968 | Varel et al. | 175/426 |
| 3,955,635 | 5/1976 | Skidmore | 175/400 |
| 5,358,063 | 10/1994 | Hedlund et al. | 175/417 |
| 5,794,728 | 8/1998 | Palmberg | 175/400 |
| 5,890,551 | 4/1999 | Liljebrand et al. | 175/418 |

FOREIGN PATENT DOCUMENTS

WO99/09292 2/1999 WIPO .

*Primary Examiner*—David Bagnell
*Assistant Examiner*—Jennifer R. Dougherty
*Attorney, Agent, or Firm*—Burns, Doane, Swecker & Mathis, L.L.P.

[57] ABSTRACT

The present invention relates to a partially enhanced drill bit (10') for percussive drilling. The bit comprises a bit body, at least one annular row of non-enhanced buttons (11') mounted in the bit body; and at least one annular row of enhanced buttons (12') mounted in the bit body radially outside of the non-enhanced buttons. At least one annular row of non-enhanced buttons (11') and said at least one annular row of enhanced buttons (12') are provided to partly overlap each other. There is an axial shoulder (19') radially outside of the non-enhanced buttons (11'). There are chamfers (20') at least partly surrounding the enhanced buttons (12'). These chamfers (20') interrupt the shoulder (19') in the circumferential direction.

9 Claims, 4 Drawing Sheets

PARTIALLY ENHANCED PERCUSSIVE DRILL BIT

BACKGROUND OF THE INVENTION

The present invention relates to partially enhanced drill bits for drilling in ground formations as defined by the preambles of the subsequent independent claims.

In percussive drilling in subterranean rock formations, a drill bit is alternatively rotated and impacted, whereby pieces of rock are broken away. The impacts can be generated locally by a down-the-hole piston, or from the ground surface.

A conventional drill bit for percussive drilling comprises a steel body with button inserts mounted on the drilling face. The buttons are arranged in generally concentric annular rows, with at least the outer row known as the gauge row, and the other rows known as the face rows, on larger bits, several outer rows may be referred to as gauge rows. The bit includes flushing holes for conducting flushing fluid that conducts-away the cuttings, In order to minimize the rate of wear of the buttons, the buttons are usually formed of a hard material such as cemented carbide. The gauge row buttons perform the most work, and thus diamond-enhanced buttons are occasionally used as gauge buttons, i.e., buttons having a diamond layer applied thereto, such as natural or synthetic diamond. Bits having diamond enhanced gauge buttons, and non-diamond enhanced face buttons are called "partially-enhanced" bits. Bits wherein both the face buttons and gauge buttons are diamond-enhanced are called "fully enhanced" bits.

The wearing of the non-enhanced face buttons requires that the bit be pulled from the ground so that the non-enhanced face buttons can be re-shaped. It is necessary to remove some of the steel bit body to expose more of the face button to enable the face button to be re-shaped. Re-shaping is performed a number of times until the face buttons are so worn that the gauge buttons become overloaded and break.

The above-described problem could be addressed by using diamond-enhanced buttons in the face, but this solution greatly increases the cost of the bit.

It would be desirable to alleviate the problem in a more cost-effective way.

OBJECTS OF THE INVENTION

One object of the present invention is to provide a drill bit with an extended life-span.

Another object of the present invention is to provide a more cost-effective drill bit.

Still another object of the present invention is to provide a drill bit having recessed gauge row insert positions to allow sufficient metal support for peripheral front face inserts.

BRIEF DESCRIPTION OF THE DRAWINGS

These objects and other advantages of the invention will become apparent from the following detailed description of preferred embodiments thereof in connection with the accompanying drawing in which like numerals designate like elements and in which.

DETAILED DESCRIPTION OF PREFERRED EMBODIMENTS OF THE INVENTION

By "diamond-enhanced" or "enhanced" button as used herein is meant a button comprised of a non-diamond base, e.g., a cemented carbide base, on which a diamond (natural or synthetic) layer has been formed. A "non-enhanced" or "non-diamond-enhanced" button is a button which does not possess a diamond layer, e.g., a cemented carbide button. A "partially enhanced" bit comprises at least one gauge row of diamond enhanced buttons, and non-enhanced face buttons.

The "wear volume" of a button is the exposed volume outside of the bit body.

"Wear volume of a row" is the combined volume of all buttons located in the row. If some buttons have only a portion thereof projecting into a row, then only that portion counts toward calculating the wear volume of the row.

Figure 1A:
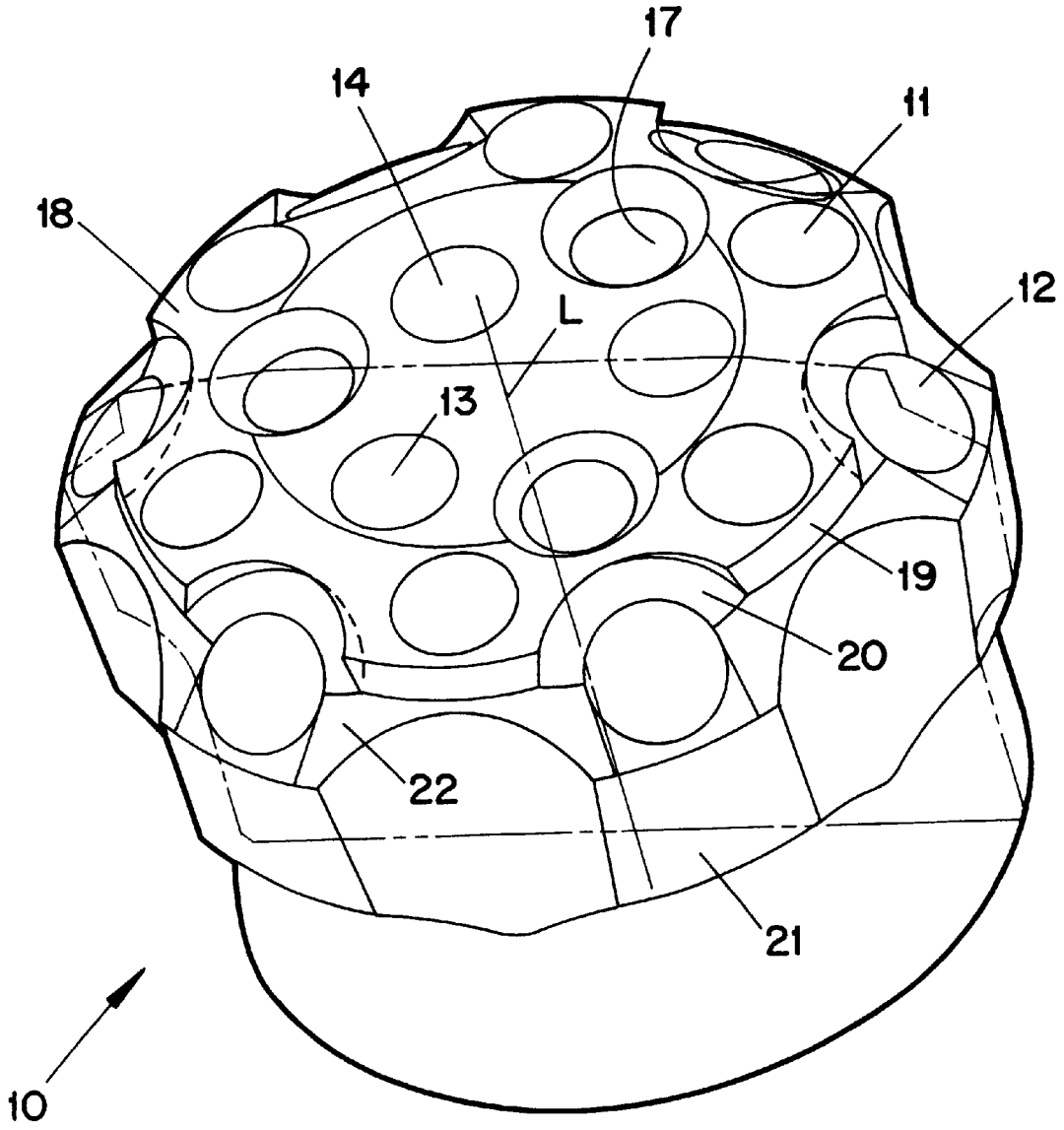
FIG. 1A is a perspective view of a drill head of a drill bit according to a first embodiment of the invention.
Figure 1B:
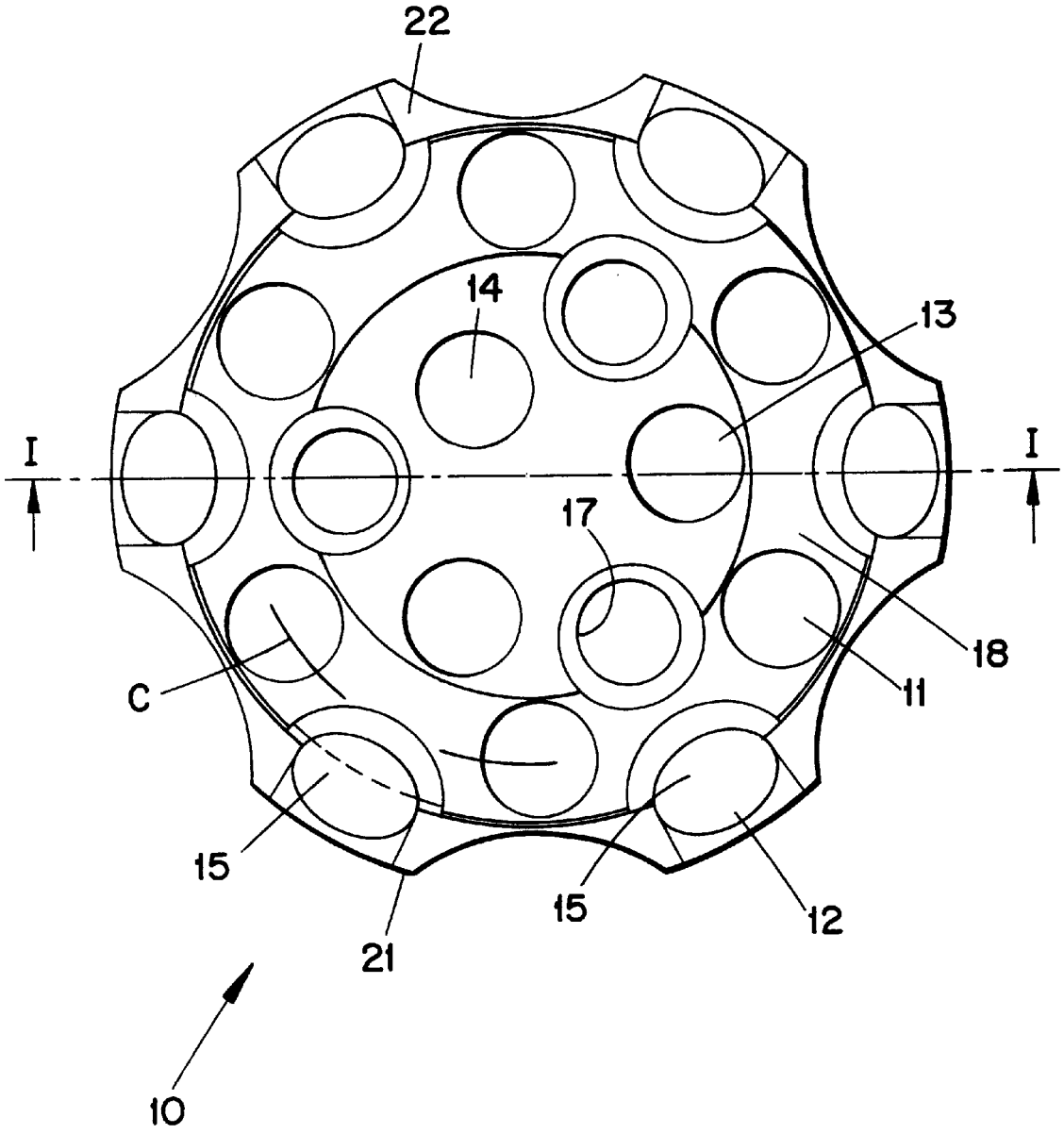
FIG. 1B is a front end view of the conventional drill bit depicted in FIG. 1A.
Figure 1C:
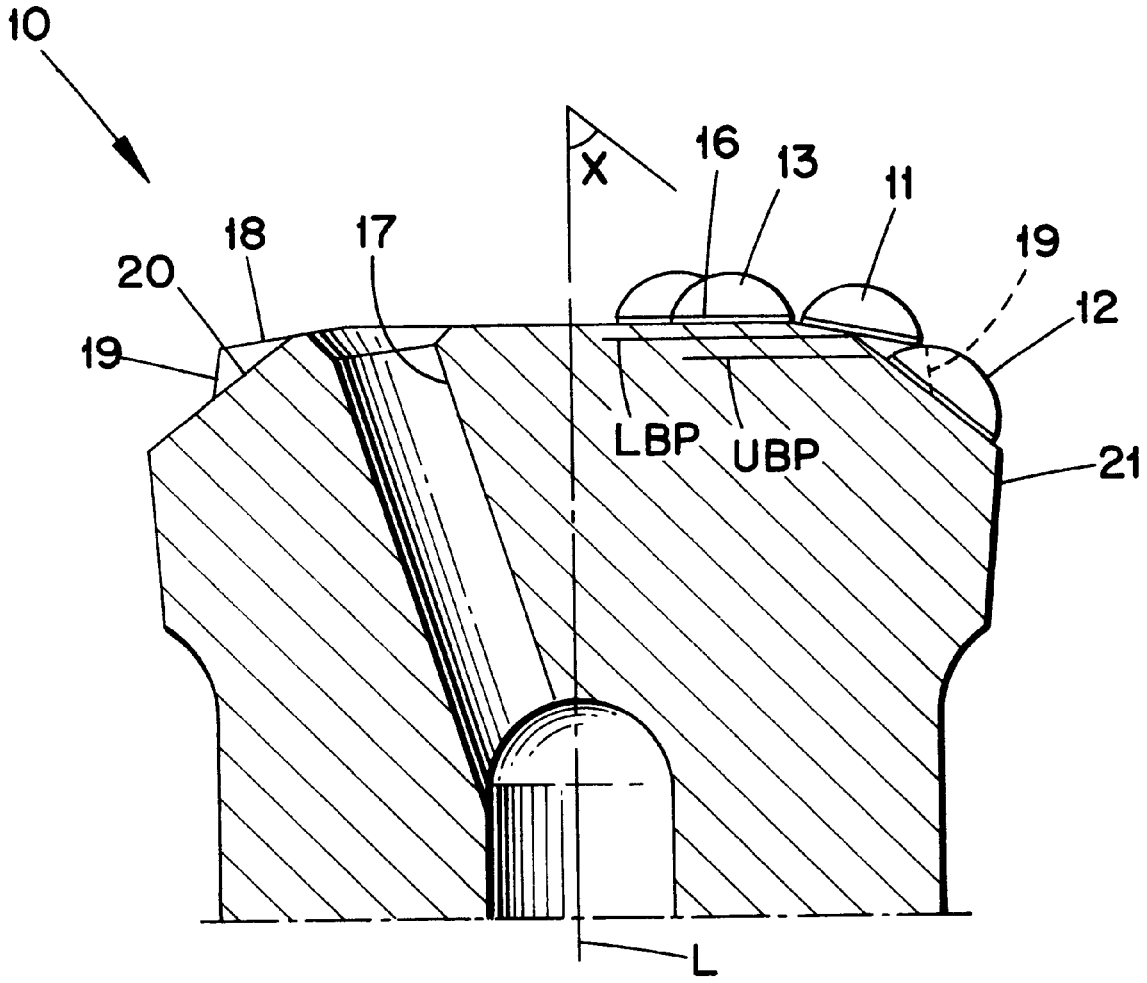
FIG. 1C is a cross-sectional view according to the line l—l in FIG. 1B.

Turning now to FIGS. 1A–1C, a partially enhanced down-the-hole drill bit 10 according to the present invention is shown. The connected shank is not shown. The bit is a so-called convex percussive bit 10 and employs non-enhanced face buttons 11 and having a gauge row of six conventional diamond-enhanced button inserts (i.e., "buttons") 12, an outer or first annular face row of six conventional non-enhanced face buttons 11, a second annular row of two conventional non-enhanced face buttons 13, and a conventional more central non-enhanced face button 14. It should be noted that FIGS. 1A and 1B show button holes only, the buttons are not shown therein only the steel bit body, however the reference numerals refer to these holes as if the buttons were shown.

At least some of the enhanced gauge buttons 12 have a larger wear volume, i.e. diameter, than the non-enhanced face buttons 11, in accordance with FIGS. 1A–1C.

It can be seen in FIG. 1B how the non-enhanced first annular row 11 radially overlap the enhanced gauge row 12 so that portions 15 of the enhanced buttons 12 will lie in an adjacent row to increase the total wear volume of that row. Thereby the wear life of the non-enhanced buttons 11 will be increased since the enhanced buttons later will perform some of the work destined for the non-enhanced buttons 11.

The figures show that three face flushing holes 17 are provided, but at least one flushing hole could also be in the form of a side flushing hole, if necessary.

Another aspect of the invention for balancing the wear life of enhanced and non-enhanced buttons Involves the relative axial relationship between the enhanced and non-enhanced buttons. Depicted in FIG. 1C is the axial relationship between the outermost row of non-enhanced face buttons 11 and the adjacent row of enhanced buttons 12 in the bit according to the present invention.

It should be pointed out that a button, regardless of whether it is diamond enhanced or not, includes a cylindrical base and a dome shaped cutting surface. As explained earlier, the base is usually formed of cemented carbide. The cutting surface of a diamond enhanced button is formed of diamond (natural or synthetic); the cutting surface of a non-enhanced button is usually formed of cemented carbide. The circular intersection line 16 between the cylindrical base and the cutting surface defines the location of a base plane of the button.

For example, in FIG. 1C, the buttons 11, 12 are inclined obliquely relative to the longitudinal axis L of the bit. Thus, the lowermost portion of the intersection line defines a lower base plane LBP of the non-enhanced button 11, and the uppermost portion of the enhanced button 12 defines an upper base plane UBP of the enhanced button 12. Note that a base plane extends perpendicular to the axis L. If a button were oriented such that its center axis were parallel to the axis L of the bit, as is the insert 13, then there would be only one base plane defined by the intersection line 16. The different possible relationships of the LBP and UBP planes have been described in PCT/SE 98/01469.

In accordance with the present invention, the lower base plane LBP of the radially outermost row of non-enhanced buttons is displaced axially forwardly with respect to an upper base plane UBP of an adjacent row of enhanced buttons disposed radially outwardly of that row of non-enhanced buttons, by a distance of at least 3 mm, and preferably up to 20 mm. The non-enhanced buttons extend obliquely with respect to the longitudinal axis L of the bit and are mounted in an oblique facet 18 of the drill bit body. That facet 18 has been displaced axially forwardly such that a longitudinal shoulder 19 is formed. The shoulder extends upwardly from a circumferential conical surface 22.

In other conceivable embodiments of drill bits according to the present invention the outermost row of non-enhanced buttons is oriented parallel to the axis L and defines a base plane. That base plane is advanced axially relative to an upper base plane of the adjacent row of enhanced buttons by a distance which is in the range of 3 to 20 mm.

In FIGS. 1A and 1B, the shoulder 19 of the steel bit body in which the non-enhanced buttons 11 are embedded and which is positioned radially outside of the non-enhanced buttons, is extended to encompass all of the bases of the non-enhanced buttons 11.

As a result of the appreciable axial advancement of the radially outermost row of non-enhanced buttons relative to the adjacent row of enhanced buttons a greater amount of wear of the non-enhanced buttons can occur before a reshaping thereof is required, thereby resulting in a considerable savings in time and expense.

Each enhanced button 12 or hole in the gauge row is at least partly surrounded by a planar recess or chamfer 20. The chamfer is made preferably by milling with an end mill thereby forming an acute angle, X relative to the longitudinal axis L of the drill bit. The diameter of the end mill used is greater than the button base diameter. The angle X is 40° to 60°, preferably about 50°. The chamfer extends radially inwardly from the envelope surface 21 of the bit 10 to about an imaginary circle C defined by the centers of the non-enhanced buttons 11. In other words, these chamfers interrupt the shoulder in the circumferential direction. The chamfer 20 makes drilling of the holes for the enhanced buttons 12 much easier while maintaining sufficient steel support for the non-enhanced buttons 11 to extend the life-span of the drill bit 10. If this steel support was not present radially outwardly of the buttons 11, these cemented carbide buttons 11 could easily break due to the bending loads occurring during percussive drilling. The circumferential conical surface forms an acute angle with the longitudinal axis L, which angle is greater than the angle X but less than 90°.

Figure 2:
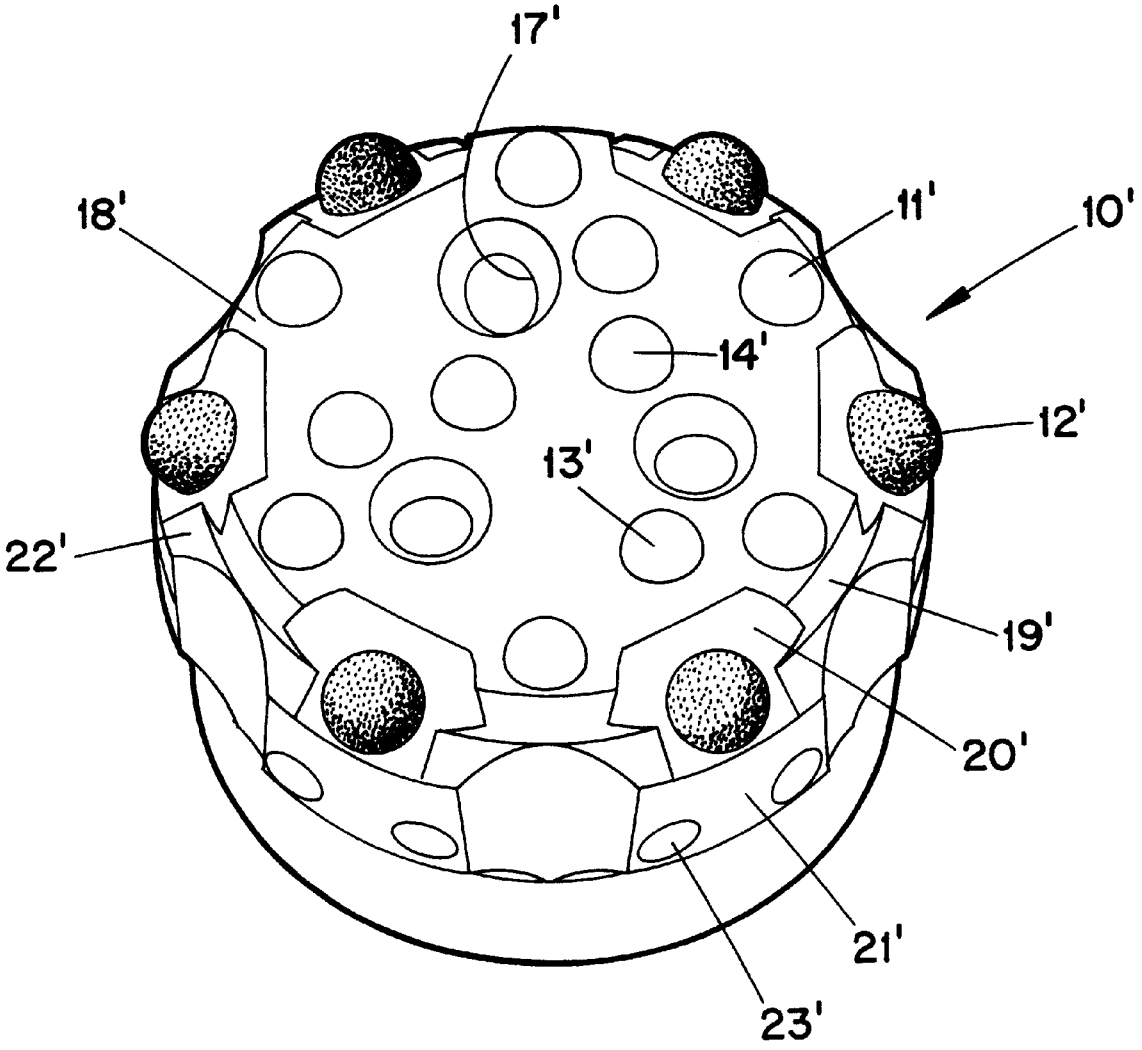
FIG. 2 is a perspective view of a drill bit according to another embodiment of the invention.

Turning now to FIG. 2, another embodiment of a partially-enhanced drill bit 10' according to the present invention is shown. The bit 10' comprises non-enhanced face buttons 11' and having a gauge row of six conventional diamond-enhanced buttons 12', an outer or first annular face row of six conventional non-enhanced face buttons 11', a second annular row of three conventional non-enhanced face buttons 13', and two conventional, more central non-enhanced face buttons 14'. This embodiment differs from the previous in that each chamfer 20' is larger than the above-described chamfer 20. The bit 10' is further provided with wear inserts 23' in the envelope surface 21'.

It will be appreciated from the foregoing description that by axially spacing the enhanced buttons from the non-enhanced buttons the risk for the enhanced buttons falling off the worn bit is minimized while still maintaining the non-enhanced buttons in a firm grip in the steel body.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A partially enhanced drill bit for percussive drilling comprising:

a bit body;

at least one annular row of non-enhanced buttons (11;11') mounted in the bit body; and at least one annular row of enhanced buttons (12;12') mounted in the bit body radially outside of the non-enhanced buttons;

said at least one annular row of non-enhanced buttons (11;11') and said at least one annular row of enhanced buttons (12;12') partly overlapping each other, characterized in that there is an axially extending shoulder (19;19') radially outside of the non-enhanced buttons (11;11') and in that there are chamfers (20;20') at least partly surrounding the enhanced buttons (12;12') and that these chamfers (20;20') interrupt said shoulder (19;19') in the circumferential direction.

2. The drill bit according to claim 1, wherein each chamfer (20;20') extends radially inwardly from the envelope surface (21;21') of the bit (10;10') to about an imaginary circle (C) defined by the centers of the non-enhanced buttons (11;11').

3. The drill bit according to claim 1, wherein each chamfer (20;20') forms a first acute angle (X) relative to a longitudinal axis (L) of the drill bit.

4. The drill bit according to claim 3, wherein the first acute angle (X) is 40° to 60°.

5. The drill bit according to claim 3, wherein a shoulder (19:19') extends upwardly from a circumferential conical surface (22;22'), the circumferential conical surface forming a second acute angle with a longitudinal axis (L) of the drill bit, said second acute angle being greater than the first acute angle (X) but less than 90°.

6. The drill bit according to claim 1, wherein at least some of the enhanced buttons (12;12') have a greater wear volume than any of the non-enhanced buttons (11;11').

7. The drill bit according to claim 1, wherein a radially outermost row of non-enhanced buttons (11;11') defines a lower base plane (LBP) which is displaced axially forwardly by a distance with respect to an upper base plane (UBP) of an adjacent row of enhanced buttons (12;12') disposed partly radially outwardly of the outermost row of non-enhanced buttons; the distance being at least 3.0 mm.

8. The drill bit according to claim 1, wherein, the bit body includes at least one channel (17;17') extending therethrough for conducting a flushing medium.

9. The drill bit according to claim 1, wherein the outermost non-enhanced buttons (11;11') are oriented parallel to or are inclined at an oblique angle with respect to a longitudinal axis of the bit.

* * * * *